US012075832B2

(12) United States Patent
Lee et al.

(10) Patent No.: US 12,075,832 B2
(45) Date of Patent: Sep. 3, 2024

(54) AEROSOL GENERATING DEVICE INCLUDING DETACHABLE HEATER MODULE

(71) Applicant: KT&G CORPORATION, Daejeon (KR)

(72) Inventors: Won Kyeong Lee, Guri-si (KR); Min Kyu Kim, Daejeon (KR); Jong Sub Lee, Seongnam-si (KR); Byung Sung Cho, Gwangmyeong-si (KR)

(73) Assignee: KT&G CORPORATION, Daejeon (KR)

( * ) Notice: Subject to any disclaimer, the term of this patent is extended or adjusted under 35 U.S.C. 154(b) by 588 days.

(21) Appl. No.: 17/294,602

(22) PCT Filed: Dec. 15, 2020

(86) PCT No.: PCT/KR2020/018305
§ 371 (c)(1),
(2) Date: May 17, 2021

(87) PCT Pub. No.: WO2021/201377
PCT Pub. Date: Oct. 7, 2021

(65) Prior Publication Data

US 2022/0400757 A1 Dec. 22, 2022

(30) Foreign Application Priority Data

Mar. 31, 2020 (KR) ..... 10-2020-0039430

(51) Int. Cl.
*A24F 40/46* (2020.01)
*A24F 40/10* (2020.01)
(Continued)

(52) U.S. Cl.
CPC ..... *A24F 40/46* (2020.01); *A24F 40/10* (2020.01); *A24F 40/40* (2020.01); *A24F 40/42* (2020.01);
(Continued)

(58) Field of Classification Search
CPC ..... A24F 40/46; A24F 40/10; A24F 40/40; A24F 40/42; A24F 40/50; A24F 40/51; A24F 40/53; A24F 40/44; A24F 40/65
See application file for complete search history.

(56) References Cited

U.S. PATENT DOCUMENTS

| | | | | |
|---|---|---|---|---|
| 10,015,990 | B2 | 7/2018 | Mironov | |
| 2016/0206003 | A1 | 7/2016 | Yamada et al. | |
| 2016/0353802 | A1* | 12/2016 | Malgat | A24F 40/42 |
| 2017/0224022 | A1 | 8/2017 | Liu | |

(Continued)

FOREIGN PATENT DOCUMENTS

| | | | | |
|---|---|---|---|---|
| CN | 109452693 A | | 3/2019 | |
| CN | 109452693 A | * | 3/2019 | A24F 47/008 |

(Continued)

OTHER PUBLICATIONS

Office Action dated Aug. 23, 2022 from the Japanese Patent Office in JP Application No. 2021-540223.

(Continued)

*Primary Examiner* — Justin M Kratt
(74) *Attorney, Agent, or Firm* — Sughrue Mion, PLLC

(57) ABSTRACT

An aerosol generating device includes: a main body including a processor and a battery; a heater module detachably coupled to the main body and including a heater configured to heat an aerosol generating material; and a cartridge detachably coupled to the heater module and storing the aerosol generating material to be delivered to the heater, wherein the heater module includes an integrated circuit electrically connected to the processor when the heater module is coupled to the main body.

11 Claims, 7 Drawing Sheets

(51) Int. Cl.

| | |
|---|---|
| ***A24F 40/40*** | (2020.01) |
| ***A24F 40/42*** | (2020.01) |
| ***A24F 40/50*** | (2020.01) |
| ***A24F 40/51*** | (2020.01) |
| ***A24F 40/53*** | (2020.01) |
| *A24F 40/44* | (2020.01) |
| *A24F 40/65* | (2020.01) |

(52) U.S. Cl.
CPC ..... *A24F 40/50* (2020.01); *A24F 40/51* (2020.01); *A24F 40/53* (2020.01); *A24F 40/44* (2020.01); *A24F 40/65* (2020.01)

(56) References Cited

U.S. PATENT DOCUMENTS

| | | | |
|---|---|---|---|
| 2017/0280774 | A1 | 10/2017 | Force |
| 2019/0014822 | A1 | 1/2019 | Bless et al. |

FOREIGN PATENT DOCUMENTS

| | | | | | |
|---|---|---|---|---|---|
| JP | 2017-507647 | A | | 3/2017 | |
| JP | 2018-174784 | A | | 11/2018 | |
| JP | 2018174784 | A | * | 11/2018 | ..... A24F 40/10 |
| WO | 2014/058678 | A1 | | 4/2014 | |
| WO | 2018/055558 | A1 | | 3/2018 | |
| WO | 2018/114263 | A1 | | 6/2018 | |
| WO | 2018/114312 | A1 | | 6/2018 | |
| WO | 2019/110669 | A1 | | 6/2019 | |
| WO | WO-2019110669 | A1 | * | 6/2019 | ..... A24F 40/10 |
| WO | 2019/173923 | A1 | | 9/2019 | |
| WO | WO-2019173923 | A1 | * | 9/2019 | ..... A24F 40/42 |
| WO | 2020/020955 | A2 | | 1/2020 | |
| WO | WO-2020020955 | A2 | * | 1/2020 | ..... A24F 40/10 |

OTHER PUBLICATIONS

International Search Report for PCT/KR2020/018305 dated Mar. 25, 2021 (PCT/ISA/210).

Written Opinion for PCT/KR2020/018305 dated Mar. 25, 2021 (PCT/ISA/237).

Office Action issued Mar. 30, 2023 in Chinese Application No. 202080007241.2.

Supplementary European Search Report issued Feb. 9, 2022 in European Application No. 20886207.8.

* cited by examiner

AEROSOL GENERATING DEVICE INCLUDING DETACHABLE HEATER MODULE

TECHNICAL FIELD

The disclosure relates to an aerosol generating device including a detachable heater module.

BACKGROUND ART

Recently, as alternative methods to overcome the disadvantages of traditional cigarettes, the demand for methods which generates aerosol by heating an aerosol generating material, rather than by combusting cigarettes has increased. For example, there has been a method in which a cartridge including a heater and a liquid storage storing an aerosol generating material is configured to be detachable from an aerosol generating device, and as power is transferred from the aerosol generating device to the cartridge, the aerosol generating material stored in the cartridge is heated by the heater.

When the aerosol generating material stored in the liquid storage of the cartridge is exhausted, the cartridge is replaced. However, in general, since a duration for which the durability of the heater is maintained is longer than a cycle for which the aerosol generating material gets exhausted, the heater may be needlessly replaced even though it can last longer. Accordingly, unnecessary waste may occur, and thus, there is a need for considering individual durability or exhaustion time of each of the components of an aerosol generating device.

DISCLOSURE OF INVENTION

Technical Problem

When a cartridge and a heater module are configured to be detachable from each other, the cartridge and the heater module may be individually replaced. Accordingly, when an exhaustion time of an aerosol generating material stored in a liquid storage inside the cartridge and the durability of the heater module are individually considered, the cartridge and the heater module may be replaced at different cycles from each other. However, while the level of the aerosol generating material stored in the liquid storage may be relatively easy to check, a user may not be able to easily check whether the durability of the heater module is exhausted and when to replace the heater module. Therefore, there is a need for accurately determining a replacement time of a heater module and notifying the user of the replacement time.

Solution to Problem

One or more embodiments include an aerosol generating device including a detachable heater module. The technical problems to be solved by one or more embodiments are not limited to the technical problems as described above, and other technical problems may be solved from the following embodiments.

Advantageous Effects of Invention

One or more embodiments include an aerosol generating device including a detachable heater module. Specifically, a heater module according to one or more embodiments may include an integrated circuit which is electrically connected to a processor in a main body of an aerosol generating device when coupled to the main body. The integrated circuit may perform counting based on a signal transmitted from the processor whenever an operation associated with the user's smoking (e.g., the user's puffy is detected by the processor and store the number of an operations corresponding to a result of the counting. The number of operations stored in the integrated circuit is proportional to a time for which the heater module performs a heating operation, and thus, whether or not the durability of the heater mode has been exhausted may be determined by using the number of operations stored in the integrated circuit. For example, a replacement time of the heater module may be accurately determined by comparing the number of operations stored in the integrated circuit with a threshold value preset in consideration of the durability of the heater module.

Also, the integrated circuit includes a nonvolatile memory for storing the counted number of operations, and thus, although a power supply to the integrated circuit is cut off as the heater module is separated from the main body, the counted number of operations may be continuously maintained. Accordingly, after the heater module is separated from the main body, although the heater module is recoupled to the main body or is coupled to another main body, use of the heater module exceeding the durability of the heater module may be prevented.

BEST MODE FOR CARRYING OUT THE INVENTION

Figure 1:
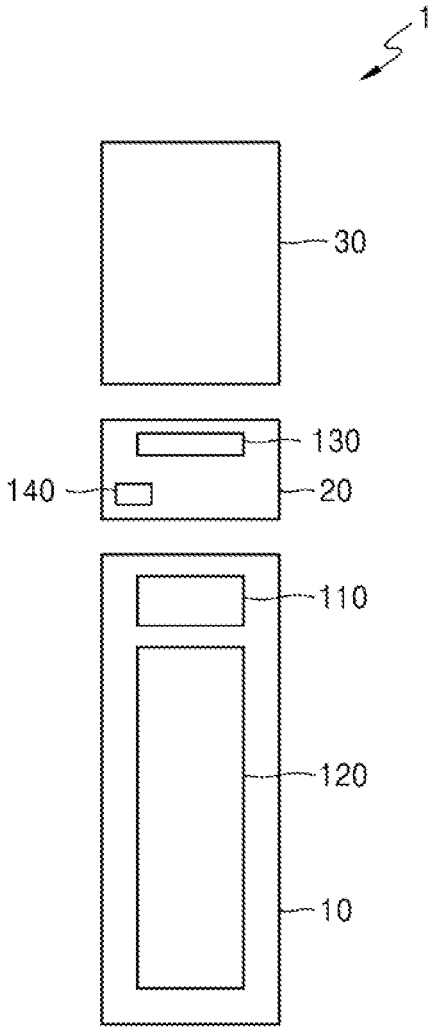
FIG. 1 is a block diagram illustrating an aerosol generating device according to an exemplary embodiment.

According to one or more embodiments, an aerosol generating device includes: a main body including a processor and a battery; a heater module detachably coupled to the main body and including a heater configured to heat an aerosol generating material; and a cartridge detachably coupled to the heater module and storing the aerosol generating material to be delivered to the heater, wherein the heater module includes an integrated circuit electrically connected to the processor when the heater module is coupled to the main body.

The processor may be configured to receive identification information from the integrated circuit and perform a genuine product certification on the heater module based on the identification information.

The integrated circuit may perform counting a number of operation associated with a user's smoking detected based on a signal transmitted from the processor and store the number of operation corresponding to a result of the counting.

The integrated circuit may include a nonvolatile memory configured to store the number of operation.

When the number of operation stored in the integrated circuit is greater than or equal to a threshold value, the processor may be configured to cut off an electrical connection between the battery and the heater.

The integrated circuit may be configured to output a first value based on the stored number of operation being less than a threshold value and output a second value based on the stored number of operation being greater than or equal to the threshold value, and the processor may be configured to allow an electrical connection between the battery and the heater based on a value output from the integrated circuit being the first value and cut off the electrical connection between the battery and the heater based on the value output from the integrated circuit being the second value.

The integrated circuit may be arranged in a space separated from the heater by at least one housing in the heater module.

The cartridge may include: a liquid storage storing the aerosol generating material; and at least one felt arranged at an end portion contacting the heater module when the cartridge is coupled to the heater module, and the heater is configured to heat the aerosol generating material delivered through the felt from the liquid storage.

The heater may include at least one of a coil heater coupled to a silica wick, and a porous ceramic heater.

The heater module may include at least two connector terminals configured to form a first electrical connection between the battery and the heater and a second electrical connection between the processor and the integrated circuit.

The integrated circuit may be connected to one or more of the at least two connector terminals through a flexible printed circuit board (FPCB) extending along at least a portion of an outer surface of the heater module.

The main body may include a circular conductive portion and a plurality of circular band-shaped conductive portions having a concentricity at an end portion of the main body coupled to the heater module, wherein the conductive portions form an electrical connection with the at least two connector terminals, regardless of an orientation in which the heater module is coupled to the main body.

Mode for the Invention

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "connected to" or "coupled to" another element, it can be directly over, above, on, connected or coupled to the other element or intervening elements may be present. In contrast, when an element is referred to as being "directly over," "directly above," "directly on," "directly connected to" or "directly coupled to" another element, there are no intervening elements present.

With respect to the terms used to describe the various embodiments, general terms which are currently and widely used are selected in consideration of functions of structural elements in the various embodiments of the present disclosure. However, meanings of the terms can be changed according to intention of one of ordinary skill in the art, judicial precedents, an emergence of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and in the context of the descriptions provided herein.

In addition, unless explicitly indicated otherwise, the word "comprise" and variations thereof such as "comprises" or "comprising" will be understood to imply the inclusion of stated elements but not the exclusion of any other elements. In addition, the terms "-er", "-or", and "module" may refer to units for processing at least one function and operation and can be implemented by hardware components or software components and combinations thereof.

As used herein, a "longitudinal direction" refers to a direction along a length of an aerosol generating device when the aerosol generating device is elongated. For example, an aerosol generating device 1 of FIG. 1 is assembled in a manner in which a main body 10, a heater module 20, and a cartridge 30 are sequentially coupled to one another. In this case, a direction from the main body 10 toward the cartridge 30 may correspond to the longitudinal direction.

Hereinafter, the present disclosure will now be described in more detail with reference to the accompanying drawings, in which exemplary embodiments of the present disclosure are shown such that one of ordinary skill in the art may easily understand and practice the embodiments of the present disclosure. The disclosure may, however, be embodied in many different forms and should not be construed as being limited to the embodiments set forth herein.

Hereinafter, one or more embodiments of the present disclosure will be described in detail with reference to the accompanying drawings.

FIG. 1 is a block diagram illustrating an aerosol generating device according to an exemplary embodiment.

Referring to FIG. 1, the aerosol generating device 1 may include the main body 10, the heater module 20, and the cartridge 30. The aerosol generating device 1 illustrated in FIG. 1 includes components associated with the present embodiment. However, it will be understood by one of ordinary skill in the art related to the present embodiment that other components may be further included in the aerosol generating device 1, in addition to the components illustrated in FIG. 1. For example, the aerosol generating device 1 may further include at least one of at least one sensor (not shown), a user interface (not shown), and a memory (not shown).

The at least one sensor may include a puff detecting sensor, a temperature detecting sensor, and the like. A result sensed by the at least one sensor may be transmitted to a processor 110 included in the main body 10, and the processor 110 may control the aerosol generating device 1 according to the sensing result to perform various functions, such as controlling operation of a heater 130 included in the heater module 20, limiting smoking, determining whether or not the cartridge 30 or the heater module 20 is coupled, and displaying a notification.

The user interface may provide a user with information regarding a state of the aerosol generating device 1. The user interface may include various types of interfacing elements such as a display or lamp for outputting visual information, a motor for outputting tactile information, a speaker for outputting sound information, terminals which communicate data with or are supplied with charge power from input/output (I/O) interfacing elements (e.g., a button or a screen) for receiving information input from the user or outputting information to the user, and a communication interface for performing wireless communication (e.g., WI-FI, WI-FI Direct, Bluetooth, near field communication (NFC), or the like) with an external device. The communication interface may include any one or any combination of a digital mode, a radio frequency (RF) modem, a WiFi chip, and related software and/or firmware. However, in the aerosol generating device 1, only some of various types of user interface examples illustrated above may be selected and implemented.

The memory may be hardware that stores various types of data processed in the aerosol generating device 1. The memory may store data processed by the processor 110 and pieces of data to be processed by the processor 110. The memory may be implemented as various types such as random access memory (RAM), dynamic random access memory (DRAM), static random access memory (SRAM), read-only memory (ROM), and electrically erasable programmable read-only memory (EEPROM). The memory may store data regarding an operation time of the aerosol generating device 1, a maximum number of puffs, a current number of puffs, at least one temperature profile, and a smoking pattern of the user, and the like.

The main body 10 may include the processor 110 and a battery 120, and the heater module 20 may include the heater 130 and an integrated circuit 140. The heater module 20 may be detachably coupled to the main body 10, and the cartridge 30 may be detachably coupled to the heater module 20. Therefore, the heater module 20 and the cartridge 30 may be individually replaced, and thus, an exhaustion time of an aerosol generating material stored in the cartridge 30 and the durability of the heater module 20 may be individually considered.

The processor 110 is hardware that controls overall operation of the aerosol generating device 1. The processor 110 may be implemented as an array of a plurality of logic gates or may be implemented as a combination of a microprocessor and a memory in which a program executable by the microprocessor is stored. In addition, it will be understood by one of ordinary skill in the art to which the present embodiment pertains that the processor 110 may also be implemented as other types of hardware.

The processor 110 analyzes the result sensed by the at least one sensor and controls process to be subsequently performed. On the basis of the result sensed by the at least one sensor, the processor 110 may control power supplied to the heater 130 so that operation of the heater 130 starts or ends. For example, when a puff is detected by the puff detecting sensor, the processor 110 may control the battery 120 to supply power to the heater 130.

The battery 120 may supply power to operate the aerosol generating device 1. For example, the battery 120 may supply power so that the heater 130 may be heated. Also, the battery 120 may supply power for operations of other hardware components provided in the aerosol generating device 1 (e.g., operations of the sensor, the user interface, the memory, and the processor 110). The battery 120 may be a rechargeable battery or a disposable battery. For example, the battery 120 may be a lithium polymer (LiPoly) battery, but is not limited thereto.

The heater 130 may refer to a device for heating an aerosol generating material. In one example, the heater 130 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. For example, the heater 130 may include at least one of a coil heater coupled to a silica wick, and a porous ceramic heater.

The integrated circuit 140 may refer to a control circuit included in the heater module 20 that is separate from the processor 110 included in the main body 10. The integrated circuit 140 may be implemented as an array of a plurality of logic gates or may be implemented as a combination of a microprocessor and a memory in which a program executable by the microprocessor is stored.

When the heater module 20 is coupled to the main body 10, the integrated circuit 140 may be electrically connected to the processor 110. The integrated circuit 140 may be electrically connected to the processor 110 and used to perform a genuine product certification on the heater module 20 or prevent excessive use of the heater module 20. Hereinafter, a process in which the integrated circuit 140 is used for a genuine product certification on the heater module 20 will be described in more detail with reference to FIG. 2.

Figure 2:
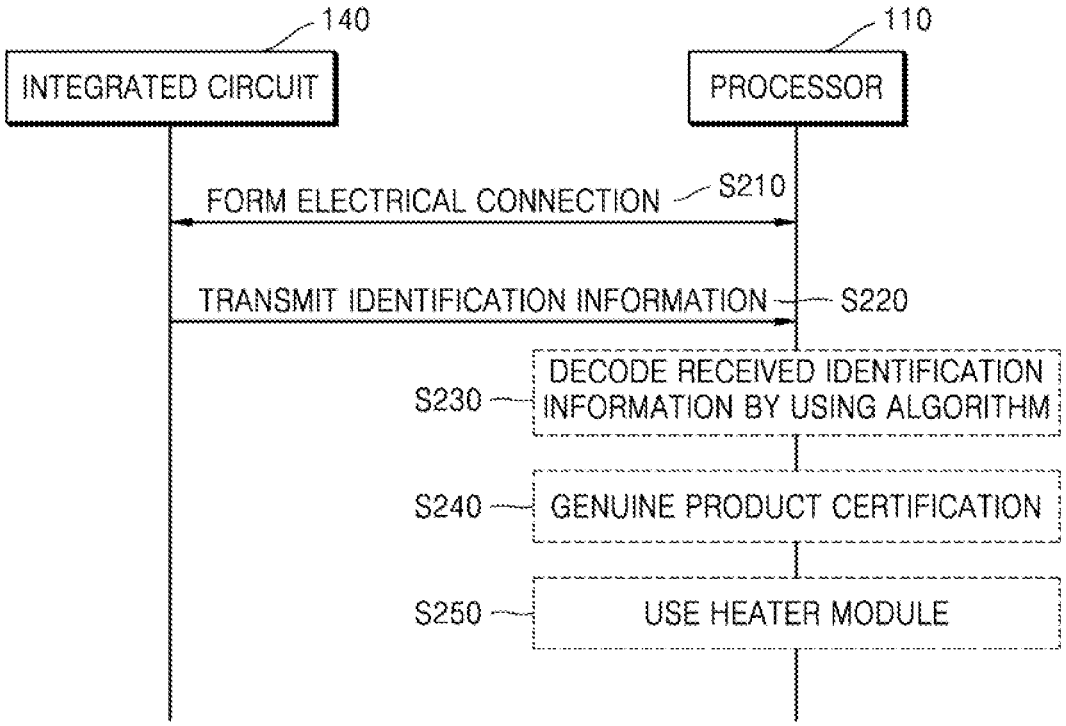
FIG. 2 is a flowchart illustrating a method of performing, by an aerosol generating device, a genuine product certification of a heater module according to an exemplary embodiment.

FIG. 2 is a flowchart illustrating a method of performing, by an aerosol generating device, a genuine product certification on a heater module according to an exemplary embodiment.

In operation S210, the integrated circuit 140 and the processor 110 may form an electrical connection. For example, as a main body (e.g., the main body 10 of FIG. 1) and a heater module (e.g., the heater module 20 of FIG. 1) are coupled to each other, and the processor 110 of the main body and the integrated circuit 140 of the heater module may be electrically connected to each other.

In operation S220, the integrated circuit 140 may transmit identification information to the processor 110. When the electrical connection with the processor 110 is formed, the integrated circuit 140 may transmit the identification information to the processor 110 even without a separate request from the processor 110. However, the integrated circuit 140 is not limited thereto and may transmit the identification information to the processor 110 upon receiving a request from the processor 110.

In operation S230, the processor 110 may decode the identification information received from the integrated circuit 140, by using an algorithm. For example, the processor 110 may decode the identification information received from the integrated circuit 140, by using various types of security algorithms including a public key encryption algorithm, a symmetric key encryption algorithm, and the like. However, the present embodiment is not limited thereto, and the decoding process according to operation S230 may be omitted. When the decoding process according to operation S230 is omitted, the processor 110 may perform operations to be described below, by using the identification information received from the integrated circuit 140.

In operation S240, the processor 110 may perform a genuine product certification on the heater module on the basis of the decoded identification information. For example, the processor 110 may perform the genuine product certification on the heater module by comparing the decoded identification information with information stored in the processor 110 or a memory connected to the processor 110. When the genuine product certification fails, the processor 110 may limit use of the heater module. Limiting the use of the heater module may indicate that a heating operation using a heater included in the heater module may not be performed by cutting off a power supply from a battery (e.g., the battery 120 of FIG. 1) to the heater.

When the genuine product certification is completed, the processor 110 may use the heater module in operation S250. For example, when an operation associated with the user's smoking is detected by at least one sensor or a user input is received, the processor 110 may perform the heating operation using the heater included in the heater module by controlling the power supply from the battery to the heater.

As described above, the processor 110 may receive the identification information from the integrated circuit 140 and perform the genuine product certification on the heater module based on the received identification information, thereby preventing uncertified heater modules from being used with the main body. The processor 110 may provide a user with information corresponding to a result of the genuine product certification, by using a user interface.

Referring to FIG. 1 again, the integrated circuit 140 may perform counting based on a signal transmitted from the processor 110 whenever an operation (e.g., the user's puff) associated with the user's smoking is detected by the processor 110 and store the number of operations corresponding to a result of the counting. The number of operations stored in the integrated circuit 140 is proportional to a time for which the heater module performs the heating operation, and thus, a replacement time of the heater module may be accurately determined by comparing the number of operation stored in the integrated circuit 140 with a threshold value preset in consideration of the durability of the heater module.

The integrated circuit 140 includes a nonvolatile memory for storing the counted number of operation, and thus, although a power supply to the integrated circuit 140 is cut off as the heater module is separated from the main body, the counted number of operation may be continuously maintained. Therefore, when the heater module is separated from the main body and the heater module is recoupled to the corresponding main body or coupled to another main body, a use exceeding the durability of the heater module may be prevented. Hereinafter, a process in which the integrated circuit 140 is used to prevent excessive use of a heater module will be described in more detail with reference to FIGS. 3 and 4.

Figure 3:
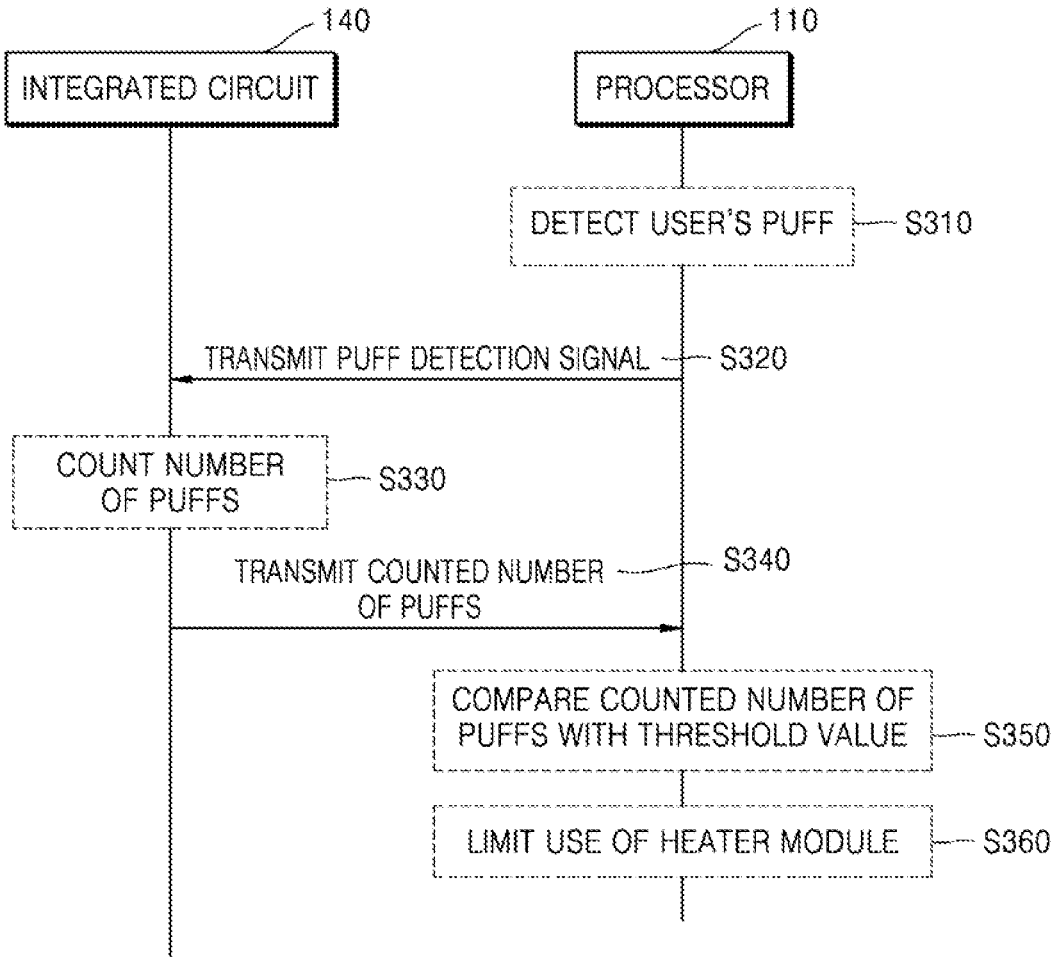
FIG. 3 is a flowchart illustrating an example of a method of preventing, by an aerosol generating device, excessive use of a heater module, according to an exemplary embodiment.

FIG. 3 is a flowchart illustrating a method of preventing, by an aerosol generating device, excessive use of a heater module according to an exemplary embodiment.

In operation S310, the processor 110 may detect a user's puff as an operation associated with the user's smoking. For example, the processor 110 may detect the user's puff by using a puff detecting sensor. The puff detecting sensor may detect a user's puff based on any one of a temperature change, a flow change, a voltage change, and a pressure change.

As the user's puff is detected, in operation S320, the processor 110 may transmit a puff detection signal to the integrated circuit 140. The puff detection signal may be transmitted to the integrated circuit 140 through at least one connector terminal on a heater module.

In operation S330, the integrated circuit 140 may count a number of puffs based on the puff detection signal transmitted from the processor 110. The integrated circuit 140 may include a counter for counting the number of puffs. Also, the integrated circuit 140 may include a nonvolatile memory for storing the counted number of puffs.

In operation S340, the integrated circuit 140 may transmit the counted number of puffs to the processor 110. As described above, the integrated circuit 140 may perform only up to counting the number of puffs and transmit the counted number of puffs to the processor 110. However, the integrated circuit 140 is not limited thereto, and may also perform a comparison with a threshold value, and an example of the corresponding case will be described later with reference to FIG. 4.

In operation S350, the processor 110 may compare the counted number of puffs with a threshold value. The threshold value may be preset in consideration of the durability of the heater module. For example, when the heater module is used until a number of user's puffs reaches 5,000 times, the durability of the heater module may be exhausted, and thus, a burnt taste occurs or becomes difficult to control heating to a desired temperature range. In this case, the threshold value may be set to 5,000 times. However, the threshold value is not limited thereto, and may be set to a value acquired by applying a certain margin to a number of puffs at which the durability of the heater module may be exhausted.

In operation S360, when the counted number of puffs is greater than or equal to the threshold value, the processor 110 may limit additional use of the heater module. The integrated circuit 140 of the heater module may store the counted number of puffs, and thus, when the heater module is coupled to another main body after the heater module is separated from a main body, additional use of the heater module may be prevented. When the number of operation stored in the integrated circuit 140 is greater than or equal to the threshold value, the processor 110 may limit additional use of the heater module by cutting off electrical connection between a battery and a heater. Also, the processor 110 may notify a user of information indicating that the additional use of the heater module is prevented or information indicating that the heater module needs to be replaced by a user interface.

Figure 4:
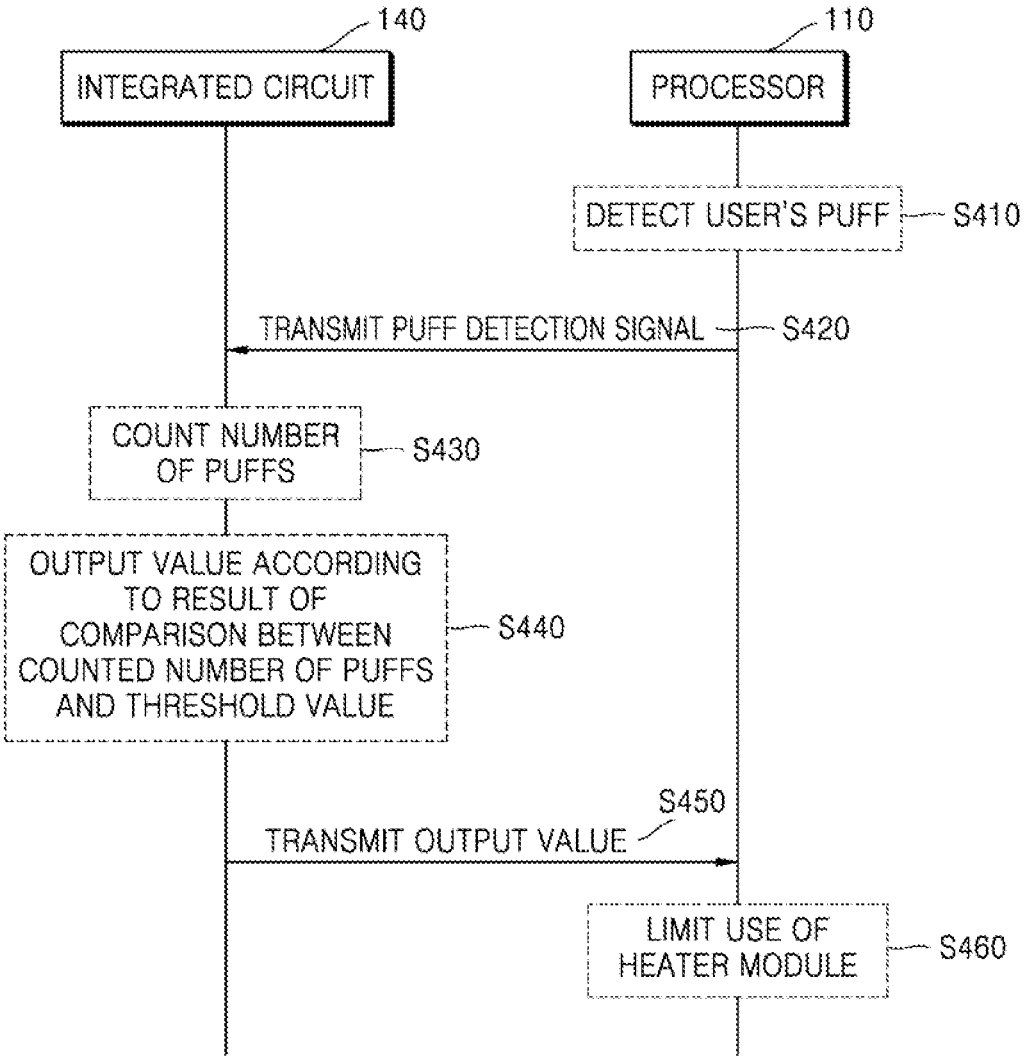
FIG. 4 is a flowchart illustrating a method of preventing, by an aerosol generating device, excessive use of a heater module, according to another exemplary embodiment.

FIG. 4 is a flowchart illustrating a method of preventing, by an aerosol generating device, excessive use of a heater module according to another exemplary embodiment.

Operations S410, S420, and S430 of FIG. 4 may correspond to operations S310, S320, and S330 of FIG. 3, respectively. Therefore, the repeated descriptions will be omitted herein.

In operation S440, the integrated circuit 140 may output a value according to a result of a comparison between a counted number of puffs and a threshold value. The integrated circuit 140 may output a first value when the counted number of puffs (i.e., the number of operation stored in the integrated circuit 140) is less than the threshold value and output a second value when the counted number of puffs is greater than or equal to the threshold value. In one example, the integrated circuit 140 may output a value of 1 to a parameter referred to as Kill when the counted number of puffs is greater than or equal to the threshold value and output a value of 0 to the parameter referred to as Kill when the counted number of puffs is less than the threshold value.

In operation S450, the integrated circuit 140 may transmit the output value to the processor 110. In one example, a value output from the integrated circuit 140 may be a value corresponding to a particular parameter (e.g., a parameter referred to as Kill) and may have a value of 0 or 1.

In operation S460, the processor 110 may determine whether the use of a heater module is to be limited, based on the value output from the integrated circuit 140. For example, the processor 110 may allow an electrical connection between a battery and a heater when the value output from the integrated circuit 140 is a first value and cut off the electrical connection between the battery and the heater when the value output from the integrated circuit 140 is a second value. As the electrical connection between the battery and the heater is cut off, additional use of the heater module may be prevented.

Referring to FIG. 1 again, the cartridge 30 may store an aerosol generating material to be transferred to the heater 130 of the heater module 20. For example, the cartridge 30 may include a liquid storage (not shown) for storing the aerosol generating material. When the cartridge 30 is coupled to the heater module 20, the aerosol generating material stored in the liquid storage may be transferred to the heater 130 of the heater module 20 through a felt (not shown). Hereinafter, a coupling structure between the heater module 20 and the cartridge 30 will be described in more detail with reference to FIGS. 5 and 6.

Figure 5:
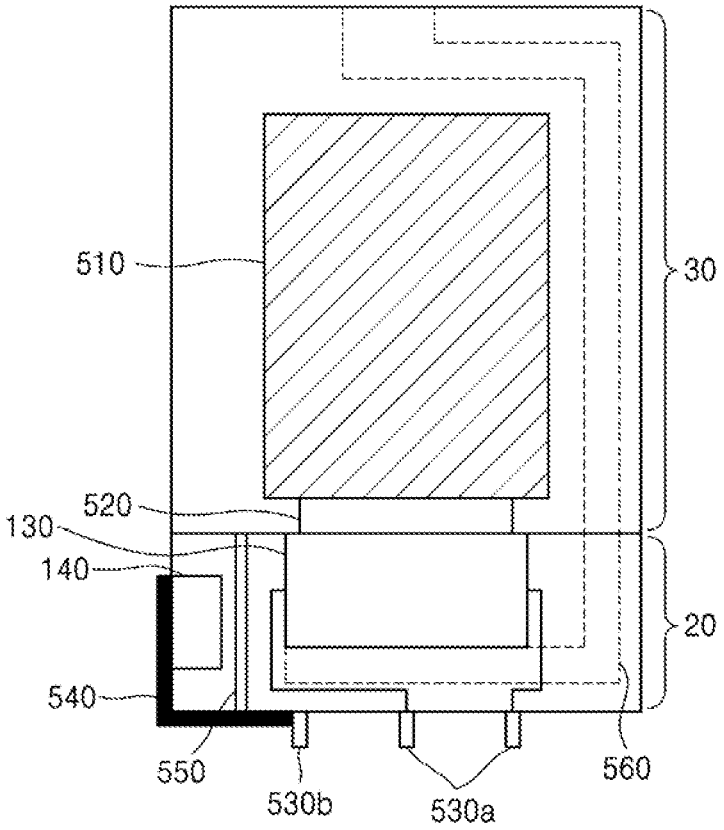
FIG. 5 is a cross-sectional view illustrating a coupling structure between a cartridge and a heater module according to an exemplary embodiment.

FIG. 5 is a cross-sectional view illustrating a coupling structure between a cartridge and a heater module according to an exemplary embodiment.

FIG. 5 illustrates a cross-sectional view of a structure in which a heater module 20 and a cartridge 30 are coupled to each other. However, the structure in which the heater module 20 and the cartridge 30 are coupled to each other is not limited to the embodiment illustrated in FIG. 5. It will be understood by one of ordinary skill in the art related to the present embodiment that, according to the design of an aerosol generating device, some of hardware components illustrated in FIG. 5 may be omitted or new components may be further added.

The cartridge 30 may include a liquid storage 510 for storing an aerosol generating material and a felt 520 configured to transfer the aerosol generating material. When the cartridge 30 is coupled to the heater module 20, the felt 520 may be arranged at an end portion of the cartridge 30 contacting the heater module 20. The aerosol generating material may be transferred from the liquid storage 510 to a heater 130 through the felt 520. In the example illustrated in FIG. 5, the heater 130 may be a porous ceramic heater. The heater 130 may include a plate-shaped porous ceramic wick to make the contact area with the felt 520 to be wider, but is not limited thereto.

The heater module 20 may include at least two connector terminals including, for example, first connector terminals 530*a* and a second connector terminal 530*b* for forming an electrical connection between a battery (e.g., the battery 120 of FIG. 1) and the heater 130 and an electrical connection between a processor (e.g., the processor 110 of FIG. 1) and an integrated circuit 140. For example, the first connector terminals 530*a* may be connected to the heater 130 and used to form the electrical connection between the battery and the heater 130. The first connector terminals 530*a* may correspond to a combination of at least two of a (+) terminal, a (−) terminal, and a ground terminal, and thus, power may be supplied from the battery to the heater 130 through the first connector terminals 530*a*.

The second connector terminal 530*b* may be connected to the integrated circuit 140 and used to form the electrical connection between the processor and the integrated circuit 140. FIG. 5 illustrates a case where the second connector terminal 530*b* follows a single wire method, but the second connector terminal 530*b* is not limited thereto. The second connector terminal 530*b* may be two (i.e., one pair) like the first connector terminals 530*a*, and the second connector terminal 530*b* may also form a pair with one of the first connector terminals 530*a*.

Each of the first connector terminals 530*a* and the second connector terminal 530*b* may have a pin structure to which a spring is applied. For example, each of the first connector terminals 530*a* and the second connector terminal 530*b* may correspond to a Pogo pin, but is not limited thereto. The structure of each of the first connector terminals 530*a* and the second connector terminal 530*b* may include any structure that has a high durability and appropriate for forming an electrical connection with a main body.

The integrated circuit 140 may be connected to one or more of at least two connector terminals through a flexible printed circuit board (FPCB) 540 extending along at least a portion of an outer surface of the heater module 20. For example, as illustrated in FIG. 5, the FPCB 540 may connect the integrated circuit 140 to the second connector terminal 530*b* to electrically connect the integrated circuit 140 to a processor of the main body.

As the heater 130 heats the aerosol generating material, a temperature around the heater 130 may significantly increase, and condensate may be generated while an aerosol generated from the heater 130 is delivered to a mouthpiece along an air flow path 560 to be inhaled by a user. Therefore, an arrangement structure for protecting the integrated circuit 140 and the FPCB 540 may be needed. For example, the integrated circuit 140 may be arranged in a space separated from the heater 130 by at least one housing (e.g., an internal housing 550) inside the heater module 20, and the FPCB 540 may extend along at least a portion of the outer surface of the heater module 20. However, the present embodiment is not limited thereto, and any appropriate arrangement structure for protecting the integrated circuit 140 and the FPCB 540 may be applied.

The air flow path 560 may be appropriately designed according to an arrangement and a structure of the liquid storage 510. In the example illustrated in FIG. 5, the liquid storage 510 may be formed in a cylindrical shape in a central portion of the cartridge 30, and thus, the air flow path 560 is designed to extend through a side of the liquid storage 510, but is not limited thereto. The structure of the air flow path 560 may include any structure through which the aerosol generated by the heater 130 may be delivered to the mouthpiece.

Figure 6:
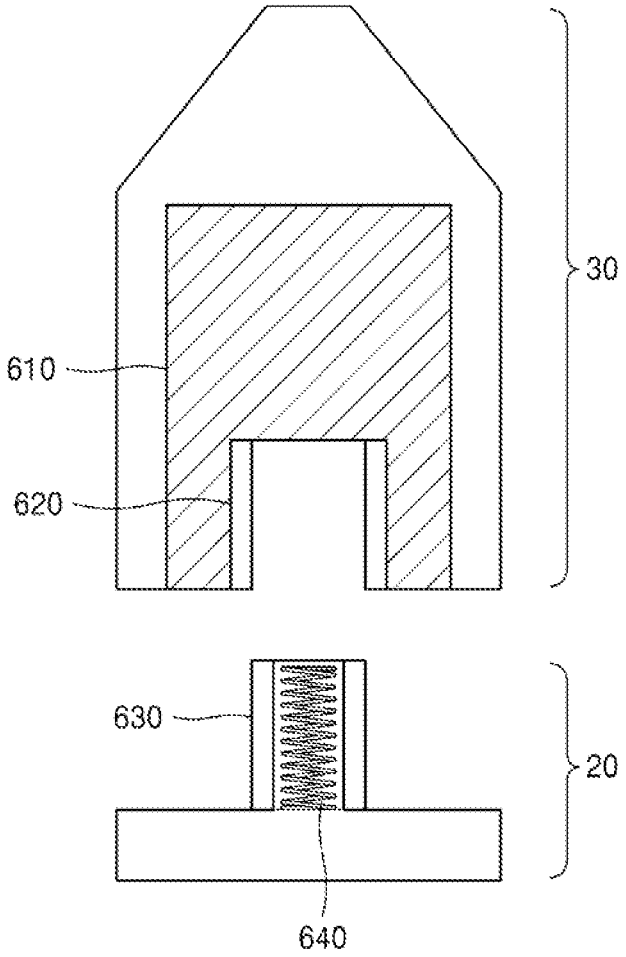
FIG. 6 is a cross-sectional view illustrating a coupling structure between a cartridge and a heater module according to an exemplary embodiment.

FIG. 6 is a cross-sectional view illustrating a coupling structure between a cartridge and a heater module according to another exemplary embodiment.

FIG. 6 illustrates a cross-sectional view of a structure in which a heater module 20 and a cartridge 30 are coupled to each other. However, the structure in which the heater module 20 and the cartridge 30 are coupled to each other is not limited to that illustrated in FIG. 6. It will be understood by one of ordinary skill in the art related to the present embodiment that, according to the design of an aerosol generating device, some of hardware components illustrated in FIG. 6 may be omitted or additional components may be included. For example, FIG. 6 illustrate that the configuration of the integrated circuit 140 of FIGS. 1 through 5 is omitted and illustrates only different components compared to FIG. 5.

The cartridge 30 may include a liquid storage 610 and a felt 620. The liquid storage 610 may include a recessed portion at an end portion thereof coupled to the heater module 20 such that the heater module 20 including a protruding portion is appropriately coupled thereto. For example, as illustrated in FIG. 6, a cylindrical hollow may be formed in at least a portion of the liquid storage 610 in a longitudinal direction. The felt 620 may be arranged to surround an inner surface of the cylindrical hollow to thereby prevent an aerosol generating material stored in the liquid storage 610 from leaking to the outside.

The heater module 20 may include a coil heater 640 coupled to a silica wick 630. The silica wick 630 may have a cylindrical shape to increase a contact area with an inner surface of the felt 620. Accordingly, an outer surface of the silica wick 630 may fully contact the inner surface of the felt 620. As the silica wick 630 contacts the felt 620, the aerosol generating material stored in the liquid storage 610 may be delivered to the silica wick 630 through the felt 620. The aerosol generating material delivered to the silicon wick 630 may be heated by the coil heater 640. FIG. 6 illustrates that the silica wick 630 is slightly spaced apart from the coil heater 640, but the silica wick 630 and the coil heater 640 may be in contact with each other.

Figure 7:
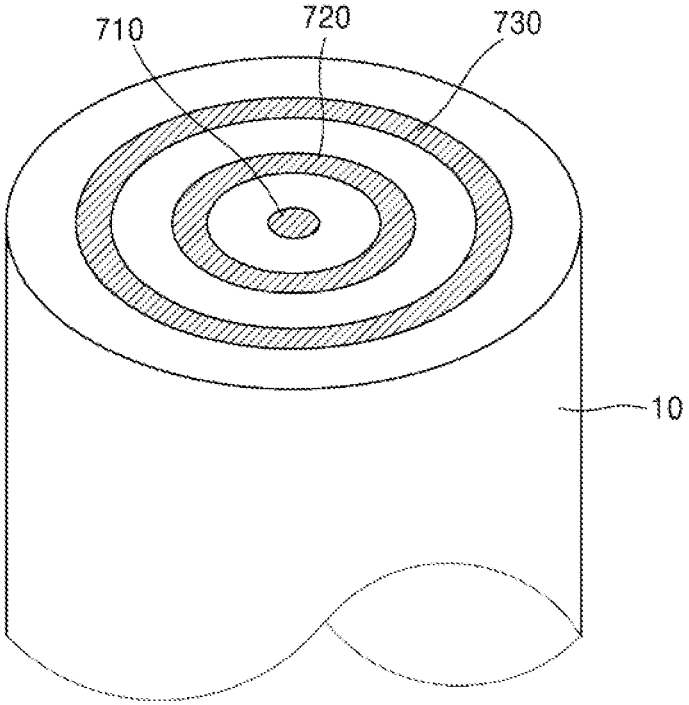
FIG. 7 is a view illustrating one end portion of a main body according to an exemplary embodiment.

FIG. 7 is a view illustrating an end portion of a main body according to an exemplary embodiment.

FIG. 7 illustrates an end portion of a main body 10 coupled to a heater module (e.g., the heater module 20 of FIG. 1, 5, or 6).

The main body 10 may include a plurality of circular or circular band-shaped conductive portions including, for example, a first conductive portion 710, a second conductive portion 720, and a third conductive portion 730. The plurality of circular or circular band-shaped conductive portions may have a concentricity at the end portion coupled to the heater module. For example, the first conductive portion 710 may have a circular shape and may serve as a ground terminal. The second conductive portion 720 may have a circular band shape concentric with the first conductive portion 710 and may be a positive (+) terminal. The first conductive portion 710 and the second conductive portion 720 may form an electrical connection with a pair of first connector terminals of the heater module, and thus, a battery in the main body 10 and a heater in the heater module may be electrically connected to each other.

The third conductive portion 730 may have a circular band shape concentric with the first conductive portion 710 and the second conductive portion 720 and may be another positive (+) terminal. The third conductive portion 730 and the first conductive portion 710 may form an electrical connection with a pair of second connector terminals of the heater mode, and thus, a processor in the main body 10 and an integrated circuit in the heater module may be electrically connected to each other. The first, second, and third conductive portions 710, 720, and 730 have a plurality of concentric circular shapes or circular band shapes, and thus may form an electrical connection with at least two connector terminals on the heater module, regardless of an orientation in which the heater module is coupled to the main body 10. Here, the orientation may refer to a degree to which the heater module rotates about a longitudinal direction of the heater module.

However, the number and arrangement of the first, second, and third conductive portions 710, 720, and 730, types of terminals, and the like are all only examples. The number and arrangement of the first, second, and third conductive portions 710, 720, and 730, types of terminals, and the like may be appropriately determined to correspond to a configuration of at least one connector terminal of the heater module. For example, the third conductive portion 730 may not be another positive (+) terminal and may not form a pair with the first conductive portion 710. The third conductive portion 730 may follow a single wire method and may also be connected to a single connector terminal of the heater module.

At least one of the components, elements, modules or units (collectively "components" in this paragraph) represented by a block in the drawings, such as the processor 110 and the integrated circuit 140 in FIGS. 1-4 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

One embodiment may also be implemented in the form of a non-transitory computer-readable recording medium storing instructions executable by a computer, such as a program module executable by the computer. The computer-readable recording medium may be any available medium that can be accessed by a computer and includes both volatile and nonvolatile media, and removable and non-removable media. In addition, the computer-readable recording medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium includes computer-readable instructions, data structures, other data in modulated data signals such as program modules, or other transmission mechanisms, and includes any information transfer media.

The above-described embodiments are merely examples, and it will be understood by one of ordinary skill in the art that various changes and equivalents thereof may be made. Therefore, the scope of the disclosure should be defined by the appended claims, and any modifications, substitutions, improvements or equivalents thereof should be construed as falling within the scope of the disclosure and the protection scope defined by the claims.

The invention claimed is:

1. An aerosol generating device comprising:

a main body including a processor and a battery;

a heater module detachably coupled to the main body and including a heater configured to heat an aerosol generating material; and a cartridge detachably coupled to the heater module and storing the aerosol generating material to be delivered to the heater, wherein the heater module comprises an integrated circuit electrically connected to the processor when the heater module is coupled to the main body, wherein the integrated circuit is configured to perform counting a number of operations associated with a user's smoking detected based on a signal transmitted from the processor and store the number of operations corresponding to a result of the counting, and wherein the number of operations is used to determine a replacement time of the heater module, which is replaced at different cycles from the cartridge.

2. The aerosol generating device of claim 1, wherein the processor is configured to receive identification information from the integrated circuit and perform a genuine product certification on the heater module based on the identification information.

3. The aerosol generating device of claim 1, wherein the integrated circuit comprises a nonvolatile memory configured to store the number of operations.

4. The aerosol generating device of claim 1, wherein, based on the number of operations stored in the integrated circuit being greater than or equal to a threshold value, the processor is configured to cut off an electrical connection between the battery and the heater.

5. The aerosol generating device of claim 1, wherein the integrated circuit is further configured to output a first value based on the stored number of operations being less than a threshold value and outputs a second value based on the stored number of operations being greater than or equal to the threshold value, and the processor is further configured to allow an electrical connection between the battery and the heater based on a value output from the integrated circuit being the first value, and cut off the electrical connection between the battery and the heater based on the value output from the integrated circuit being the second value.

6. The aerosol generating device of claim 1, wherein the integrated circuit is arranged in a space separated from the heater by at least one housing in the heater module.

7. The aerosol generating device of claim 1, wherein the cartridge comprises:

a liquid storage storing the aerosol generating material; and at least one felt arranged at an end portion contacting the heater module when the cartridge is coupled to the heater module, wherein the heater is configured to heat the aerosol generating material delivered through the felt from the liquid storage.

8. The aerosol generating device of claim 1, wherein the heater comprises at least one of a coil heater coupled to a silica wick and a porous ceramic heater.

9. The aerosol generating device of claim 1, wherein the heater module comprises at least two connector terminals configured to form a first electrical connection between the battery and the heater and a second electrical connection between the processor and the integrated circuit.

10. The aerosol generating device of claim 9, wherein the integrated circuit is connected to one or more of the at least two connector terminals through a flexible printed circuit board (FPCB) extending along at least a portion of an outer surface of the heater module.

11. The aerosol generating device of claim 9, wherein the main body comprises a circular conductive portion and a plurality of circular band-shaped conductive portions having a concentricity at an end portion of the main body coupled to the heater module, wherein the conductive portions form an electrical connection with the at least two connector terminals, regardless of an orientation in which the heater module is coupled to the main body.

* * * * *